United States Patent [19]

Seguchi et al.

[11] 4,046,670

[45] Sept. 6, 1977

[54] METHOD FOR THE TREATMENT OF HEAVY PETROLEUM OIL

[75] Inventors: Koji Seguchi, Hino; Minoru Sugita; Kazuyoshi Inada, both of Tokyo; Kiyoshi Tagaya, Funabashi; Yuji Nakamura, Tokyo, all of Japan

[73] Assignee: Kureha Kagaku Kogyo Kabushiki Kaisha, Tokyo, Japan

[21] Appl. No.: 713,356

[22] Filed: Aug. 11, 1976

Related U.S. Application Data

[63] Continuation-in-part of Ser. No. 680,439, April 26, 1976, abandoned.

[30] Foreign Application Priority Data

Apr. 30, 1975 Japan ..... 50-51266

[51] Int. Cl.[2] ..... C10G 9/16

[52] U.S. Cl. ..... 208/48 AA; 208/121; 208/126; 208/127; 208/157; 208/253; 252/474

[58] Field of Search ..... 208/47, 48 AA, 126, 208/127, 157, 253, 121, 54

[56] References Cited

U.S. PATENT DOCUMENTS

| | | | |
|---|---|---|---|
| 2,001,313 | 5/1935 | Pelzer | 208/47 X |
| 2,124,566 | 7/1938 | Grosse | 208/121 |
| 2,288,613 | 7/1942 | Dill | 208/121 |
| 2,320,118 | 5/1943 | Blaker | 208/226 X |
| 2,329,834 | 9/1943 | Hays | 208/47 X |
| 3,915,844 | 10/1975 | Ueda et al. | 208/127 |
| 3,936,371 | 2/1976 | Ueda et al. | 208/253 |
| 3,983,030 | 9/1976 | Rosynek et al. | 208/126 X |

*Primary Examiner*—Herbert Levine
*Attorney, Agent, or Firm*—Lane, Aitken, Dunner & Ziems

[57] ABSTRACT

In the thermal cracking of heavy petroleum oil (having an API specific gravity of not more than 25) in a tubular type heating furnace, a specific inorganic substance is added in a specific proportion to the heavy petroleum oil to prevent the heavy oil from undergoing coking inside the furnace.

3 Claims, 11 Drawing Figures

METHOD FOR THE TREATMENT OF HEAVY PETROLEUM OIL

CROSS-REFERENCE TO RELATED APPLICATION

The present application is a continuation-in-part of our copending application Ser. No. 680,439, filed Apr. 26, 1976, now abandoned and entitled A METHOD FOR THE TREATMENT OF HEAVY PETROLEUM OIL and claims the priority of Japanese application No. 51266/1976, filed Apr. 30, 1975.

FIELD OF THE INVENTION

This invention relates to a method for treatment of a heavy petroleum oil having an API specific gravity (specific gravity determined in accordance with the method established by the American Petroleum Institute) of not more than 25. More particularly, the present invention relates to a method whereby thermal cracking of the heavy petroleum oil within a tubelar type heating furnace is effected without coking within the furnace.

BACKGROUND OF THE INVENTION:

Generally, the heavy petroleum oil having an API specific gravity of not more than 25 contains in a large proportion a heavy fraction called "asphaltene" which has a molecular weight of not less than 1000, a heavy aromatic content and a high fixed carbon content. This heavy petroleum oil, therefore, has an extremely high specific gravity and viscosity and a high ash content and accordingly, is difficult to handle. When the heavy petroleum oil is used as a fuel, for example, it usually has its viscosity lowered by addition of a light fraction, although it may be used in its unmodified form in some cases. When a blend of reduced viscosity, is used as a fuel in a boiler for example, it may cause coking or scale formation in the boiler (which problems are held to originate in the asphaltene contained in the blend). Thus, the blend is not suitable as a fuel.

For the heavy petroleum oil to be advantageously used as a fuel or for industrial purposes, it has been conventional practice to thermally crack the heavy petroleum oil within a tubular type heating furnace for conversion into a light oil. In the course of this thermal cracking treatment, however, coke is produced from the feed oil and is suffered to deposit inside the furnace tube and the deposited coke produces a clogged furnace interior and degraded thermal conductivity, with the result that the furnace operation is jeopardized and the resultant light oil is adversely affected in terms of quality and yield. Moreover, whenever there occurs deposition of coke and other residues in the furnace interior, it becomes necessary for the furnace interior to be free from the deposited coke. The operation for the removal of the deposited coke requires much time and labor and involves harsh conditions and, consequently, gradually aggravates the wear of the furnace.

SUMMARY OF THE INVENTION

The object of the present invention, therefore, is to provide a method for advantageous treatment for the heavy petroleum oil, whereby thermal cracking can effectively be carried out on the heavy petroleum oil without coking with the furnace system.

This object and the other objects of the present invention will become apparent from the following description.

According to the present invention, there is provided a method for the treatment of heavy petroleum oil having an API specific gravity of not more than 25, which method includes having a specific inorganic substance added as an anti-clogging agent in a specific proportion to the heavy petroleum oil and subjecting the resultant mixture to a thermal cracking treatment.

BRIEF EXPLANATION OF THE DRAWINGS:

Referring to the accompanying drawing.

Figure 1:
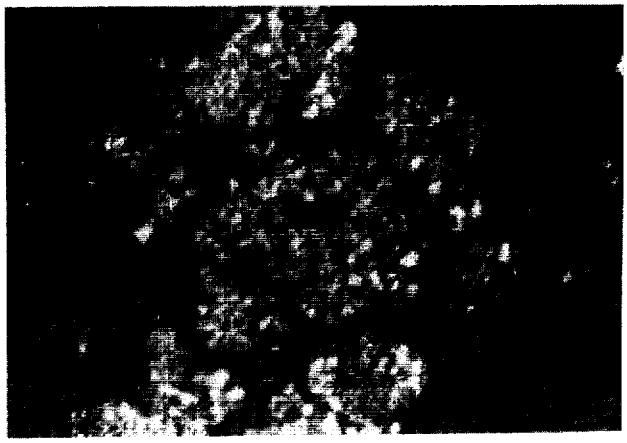
FIG. 1 is a polarized photomicrograph of a pitchy or coky substance existing in the bottom oil which occurs when the heavy petroleum oil (having an API specific gravity of not more than 25) is subjected to the thermal cracking treatment without incorporation of the inorganic substance used in the present invention.

DETAILED DESCRIPTION OF THE INVENTION:

The types of heavy petroleum oil for which the treatment of the present invention is intended are those which have values of API specific gravity not exceeding 25 and having relatively high asphaltene contents. Examples are heavy crude oils; heavy fractions such as atmospheric residues and vacuum residues of crude oils and solvent extracted asphalt; oils such as tar sand oil, natural asphalt and shale oil which are held to be substantially similar to crude oils; and heavy fractions of such oils.

The inorganic substance which is used in the present invention as an anti-clogging agent for incorporation into the heavy petroleum oil is obtained by alkali treatment of an inorganic material containing as its principal components an iron oxide and a high melting oxide such as silica, alumina or magnesia. This inorganic substance has a surface area of not less than 30 $m^2/g$, preferably from 30 to 200 $m^2/g$ (as determined by what is called "BET method"), and an average particle diameter of not more than 30 microns. Examples of inorganic materials containing the iron oxide and the high melting oxide as principal components are Laterite, Garnierite, Magnesite, Bauxite, Fly ash and Kyoto yellow ochre. These inorganic materials have the following compositions:

| | Principal components | (Minor components) |
|---|---|---|
| Laterite | $Fe_2O_3$,$Fe_3O_4$,$SiO_2$,$Al_2O_3$, | (Cr, Ni) |
| Garnierite | $SiO_2$,MgO,$Fe_2O_3$,$Fe_3O_4$, | (Ni, Cr, Co) |
| Magnesite | MgO,CaO,(Fe,$Al_2$)$O_3$, | |
| Bauxite | $Al(OH)_3$,$Fe_2O_3$,$SiO_2$, | (Ti) |
| Fly ash | $SiO_2$,$Al_2O_3$,$Fe_3O_4$,$Fe_2O_3$, | |
| Kyoto yellow ochre | $Al_2O_3$,$SiO_2$,$Fe_2O_3$. | |

Any of the listed inorganic materials can be subjected to an alkali treatment to produce the anti-clogging agent of the present invention. The alkali treatment is, for example, accomplished simply by pulverizing the inorganic material to a particle diameter of not more than 150 microns and bringing the resultant powder into contact with an aqueous solution of an alkali. Consequently, the powdered inorganic material has its surface acted upon by the alkali to produce an inorganic substance of a porous structure. For use in this alkali treatment, the aqueous alkali solution is prepared simply by dissolving in water a salt of an alkali metal or an alkaline earth metal. From the standpoint of solubility in water, the hydroxide or carbonate of sodium, potassium or barium is preferred over other salts of alkali metals and alkaline earth metals. Use of sodium hydroxide proves to be particularly practicable. The concentration of the aqueous solution of alkali suitably exceeds 0.1N, preferably falling in the range of from 1 to 10N. The length of the alkali treatment is usually in the range of from 1 to 30 hours. The treatment is effectively carried out at temperatures of not less than 100° C, preferably in the range of from 100° to 200° C under reflux or in an autoclave. After completion of the reaction, the inorganic substance aimed at is obtained by recovering the sediment from the reaction system, freeing the product from the excess alkali adhering thereto by washing the sediment with water and thereafter drying the refined sediment. The residue which is referred to as "red mud" and which is obtained by subjecting Bauxite to an alkali treatment in accordance with the so-called Bayer's process is embraced as one of the inorganic substances usable for the present invention.

The present invention requires the inorganic substance to be added in a proportion of 0.2 to 5 percent by weight, preferably 0.2 to 2 percent by weight, to the heavy petroleum oil (having an API specific gravity viscosity of not more than 25). The reason for this limitation resides in the ascertained fact that when the heavy petroleum oil having incorporated therein the inorganic substance is subjected to the thermal cracking treatment, coking is almost completely avoided within the reaction system if the ratio of the surface area of the inorganic substance to the area of the internal wall surface of the system exceeds 100. The reason for the upper limit of the range is an attempt to avoid occurrence of erosion and similar troubles in the system as the result of addition of such inorganic substance.

As the next step of the present invention the heavy petroleum oil incorporating the inorganic substance is introduced into a tubular type heating furnace and subjected therein to thermal cracking at temperatures of not less than 400° C, preferably in the range of from 400 to 500° C. For this purpose it is sufficient that the pressure within the furnace be in the range of from normal atmospheric pressure to 30 $kg/cm^2$ and that the length of the treatment be in the approximate range of from 1 to 15 minutes. By subjecting the heavy petroleum oil to the thermal cracking treatment in the manner as described above, the heavy petroleum oil produces an oil having low specific gravity and low viscosity without coking. When the vacuum residue of Khafji crude having a viscosity of several hundred thousand centipoises is subjected to the thermal cracking treatment as described above, for example, it is converted into an oil having a viscosity of about 2000 centipoises. Also when the heavy petroleum oil is subjected to the thermal cracking treatment, the content of heavy metals such as nickel and vanadium in the produced oil is lower than the original content of the same heavy metals in the heavy petroleum oil before the treatment. When the oil produced through the thermal cracking treatment is used as a fuel for boiler, for example, the scaling problem due to vanadium corrosion of superheater pipes in the boiler is less severe than when the normal heavy oil is used as the fuel. The decreased content of the heavy metals in the produced oil as compared with the original content in the heavy petroleum oil may presumably be attributed to adsorption of the heavy metals by the inorganic substance added to the heavy petroleum oil. To be more specific, the inorganic substance is a porous material having a relatively high melting point and containing 5 to 50 percent by weight of iron mainly as iron oxide and also containing not more than 1 percent by weight of an alkali metal such as sodium and potassium. Therefore, the matrix of the porous material contains iron which may be considered preferred solvent for vanadium and similar heavy metals and has dispersed therein as alkali metal capable of lowering the melting point of the salt such as of vanadium. In the course of the thermal cracking treatment, heavy metals such as vanadium which are contained in the heavy petroleum oil have their solubility to iron enhanced by the alkali metal so that they possibly are adsorbed by the inorganic substance.

According to the present invention, the heavy petroleum oil can effectively be subjected to the thermal cracking treatment without coking as described above. Moreover, the product oil has lower heavy metal content than the feed oil. The present invention, therefore, makes a great contribution to the thermal cracking of heavy petroleum oil. The oil which is obtained in consequence of the thermal cracking of the heavy petroleum oil according to the present invention can be put to a rich variety of uses, as occasion demands, after it has been freed from the inorganic substance.

Where the afore-mentioned oil which contains an inorganic substance according to the invention is burned as a fuel, the resulting exhaust gases contain reduced amounts of toxic components such as $SO_x$ and $NO_x$ as compared with where no inorganic substance is added to the oil. In other words, the oil of the invention incorporating an inorganic substance has a great advantage as a fuel oil in the reduction of air pollution as well of the corrosion of combustion equipment. Even when the inorganic-substance-containing oil is used in admixture with other known fuel oils, there advantages can be retained to a certain degree depending upon the mixing ratio.

The present invention will be described more specifically with reference to working examples, which are solely illustrative of and not limitative in any way of the present invention.

EXAMPLE 1

Iranian Heavy crude was introduced into a Pyrex flask having an inner volume of about 200 liters, kept at a temperature of 350° C by means of a mantle heater and agitated at 60 rpm and, at the same time, stripped with nitrogen gas to distill off about 48 percent by weight of the light fraction. Consequently, there was obtained an oil having an API specific gravity of about 1.7. This has similar properties to the commercially produced atmospheric residue of Iranian Heavy.

Then to this oil, Laterite produced in Acoje, Philippines which had in advance been treated with caustic soda was added in a proportion of 1 percent by weight. The resultant mixture was delivered by a gear pump at a rate of about 2 liters per hour to a stainless steel tube having a 8 mm inside diameter and 15 m in length and subjected to a heat treatment therein.

For the purpose of this heat treatment, the oil was heated in advance to about 60° C while in the storage tank, from which it was continuously delivered to the gear pump via a heated line. The stainless steel tube used for the heat treatment was wound in a spiral shape, submerged in a metal bath and kept at 460° C by heating. On completing the pass through the tube, the oil is delivered to a vertical flushing tower having an inner volume of about 10 liters. This tower had its interior kept at a temperature of about 200° C and it was adapted so that the gas fraction and the light fraction could be distilled out and collected through the top of the tower. In addition to the operating conditions mentioned above, the interior pressure of the system was kept at about 0.5 kg/cm$^2$.

The surface area of the inner wall of the tube was about 2.5 cm$^2$ per cm of tube length, whereas the surface area of the additive held within the same length of the tube interior was about 4,000 cm$^2$ since the average surface area of the additive was about 80 m$^2$/g, indicating that the additive had a surface area about 1,600 times as large as that of the tube for the unit length of 1 cm. The additive was ascertained to have an average particle diameter of not more than 30 microns, including particles measuring less than 1 micron in diameter. During this operation, the phenomenon of coking occurred very little within the tube. Under the operating conditions described above, the operation could be continued for one week without encountering any trouble. When the same operation was carried out under the same conditions without incorporation of the additive into the oil, pressure fluctuation began to occur in the tube and sign of local formation of coking began to appear within several hours of start of the operation. It was observed that tube clogging or a similar phenomenon resulted after 10 to 20 hours of this operation. As a test intended for determination of the length of time of operation which accelerated occurrence of coking a comparative test was performed with the heating temperature alone varied in the range of from 460° to 485° C. It was consequently found that in the operation involving the incorporation of the additive, the coking cycle accelerating the formation of coke (the time required for the internal pressure to reach 30 kg/cm$^2$) was about eight times as great as in the operation without incorporation of the additive.

The resultant oil (the bottom oil in the flushing tower) obtained by the foregoing treatment of the feed oil was heated at 120° C, centrifuged (with a centrifugal force of about 2,000 G) and recovered by separation through decantation.

The centrifuged supernatant from the bottom oil of the flushing tower and the distillate off the flushing tower were combined in entirety. It was ascertained through the atomic absorption analysis of the calcined product of the resultant mixture that the mixture contained 6 ppm of vanadium, less than 1 ppm of nickel and less than 8 ppm of sodium as compared with 195 ppm of vanadium, 60 ppm of nickel and 15 ppm of sodium originally contained in the feed oil, indicating that the treatment resulted in notable decreases in the metal contents. On the other hand, the residue from the separation of the bottom oil of the flushing tower was found to entrain a pitchy or coky matter in an amount of less than 1 percent by weight based on the amount of the feed oil, in addition to the metals. When the bottom oil of the flushing tower was extracted at 60° C with quinoline, the quinoline-insoluble matter was found to have a concentration of less than 0.3% by weight (exclusive of the additive), indicating that the formation of coky matter occurred very little. Measurement by use of a rotary type viscosimeter showed that the mixture of total the bottom oil with the total distillate of the flushing tower had a viscosity of 35 cp at 50° C, whereas the feed oil had a viscosity of 460 cp at the same temperature, indicating that the treatment had lowered the viscosity to a great extent.

Figure 2:
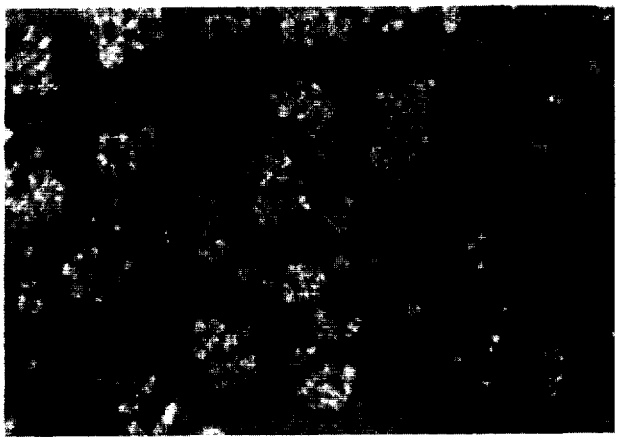
FIG. 2 is a polarized photomicrograph of a pitchy or coky substance existing in the bottom oil which occurs when the heavy petroleum oil (having an API specific gravity of not more than 25) is subjected to the thermal cracking treatment in accordance with the present invention.

The pitchy or coky substance which occurred in the bottom oil of the flushing tower and subsequently separated itself in the form of centrifugal residue in the accelerated coking test was examined through a polarized microscope. The results revealed that the amount of coky substance in the case not involving the incorporation of the additive was about 10 to 20 times as large as in the case wherein 1 percent by weight of the additive was used. Furthermore, from the structural point of view, the former pitchy or coky substance was observed to have a much more orderly crystalline arrangement than the latter one. These conditions are clearly seen from the photographs of FIG. 1 (omission of use of additive) and FIG. 2 (involving use of additive).

Figure 3:
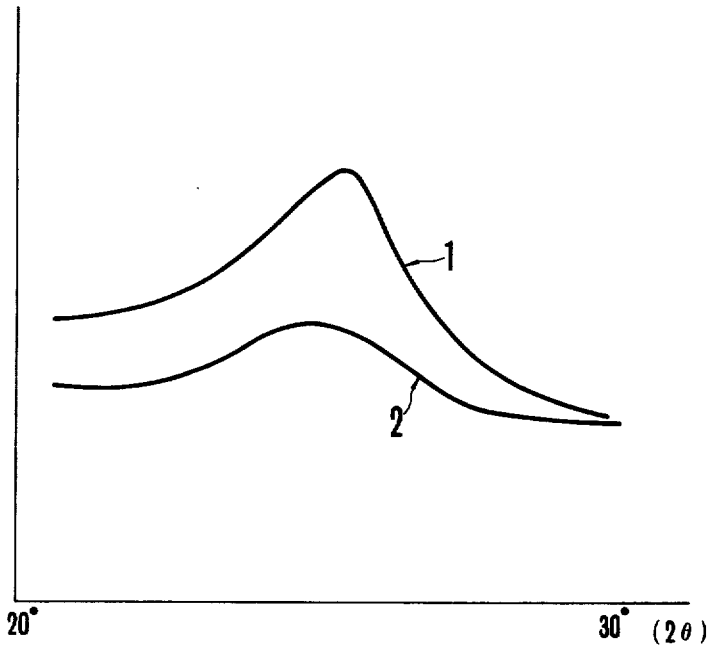
FIG. 3 is a wide-angle X-ray diffraction diagram comparing the extraction residues which are obtained when the heavy petroleum oil (having an API specific gravity of not more than 25) containing the inorganic substance used in the present invention and not containing the inorganic substance are subjected to the thermal cracking treatment and the residues from the resulting bottom oils are hot extracted with quinoline.

An X-ray examination given to what had remained after the hot extraction of the residue of the bottom oil of the flushing tower at 60° C with quinoline revealed that the crystallinity of the pitchy or coky substance was as indicated by observation through the polarizing microscope. The results of the X-ray examination are graphically shown in FIG. 3. FIG. 3 represents a wide-angle X-ray diffraction diagram (Ni/Cu, Kα 30 KV 15 mA, slit 1°, 1°, 0.1 mm/mm). In the graph of FIG. 3, 1 denotes a curve of the data obtained of the test run not involving incorporation of the additive and 2 a curve of the data obtained of the test run involving incorporation of 1 percent by weight of the additive. It is clearly seen from FIG. 3 that the size of crystals and the size of lattice spacking are both greater in the product obtained omitting the additive than in the product obtained incorporating the additive.

Figure 4:
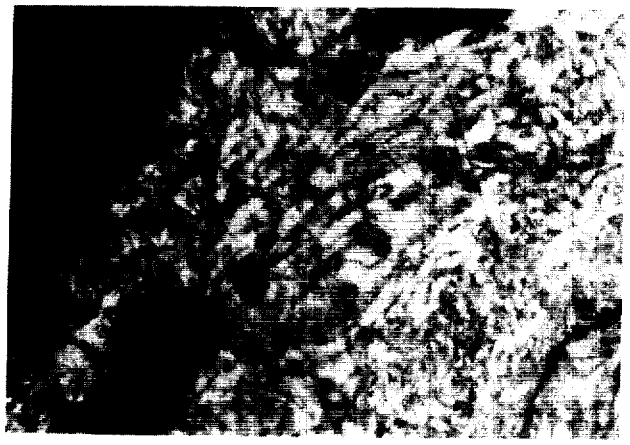
FIG. 4 is a polarized photomicrograph of a cut specimen of coke taken from the interior of tubelar type heating furnace in which the product of coking has deposited in the thermal cracking treatment carried out within the tubelar type heating furnace on the heavy petroleum oil (having an API specific gravity of not more than 25) in accordance with the prior art.
Figure 5:
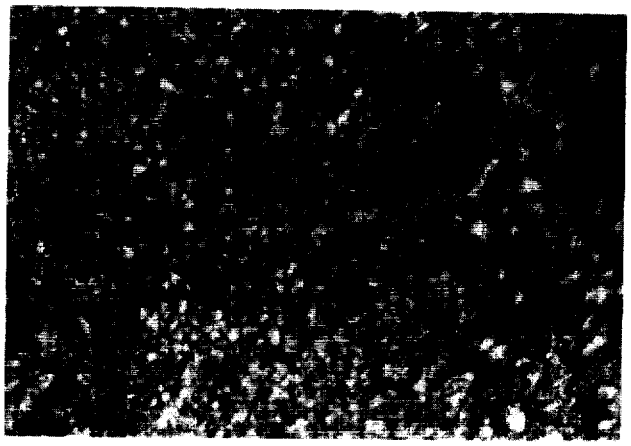
FIG. 5 is a polarized photomicrograph of a cut specimen of coke taken from the interior of tubelar type heating furnace in which the product of coking has deposited in the thermal cracking treatment carried out within the tubelar type heating furnace on the heavy petroleum oil (having an API specific gravity of not more than 25) in accordance with the present invention.

Specimens cut off the coke formed inside of the tube were subjected to the same observation. The results confirm that the aforementioned difference was manifested in a more prominent manner. The conditions are shown in the photographs of FIG. 4 (no additive) and FIG. 5 (additive), respectively.

Figure 6:
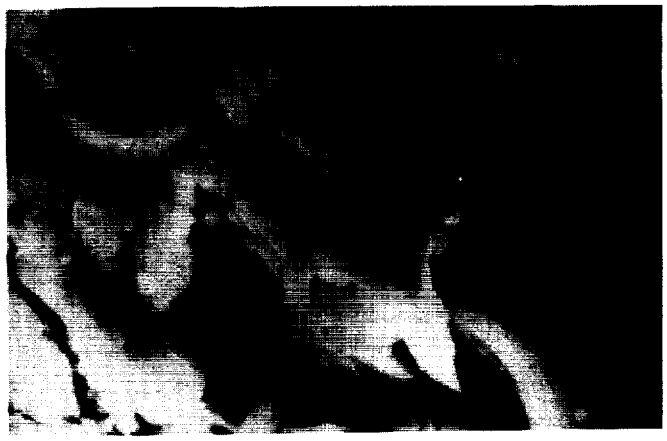
FIG. 6 is a photograph taken through a scanning electron microscope of the extraction residue which occurs when the cut specimen of coke in FIG. 4 is hot extracted with quinoline.
Figure 7:
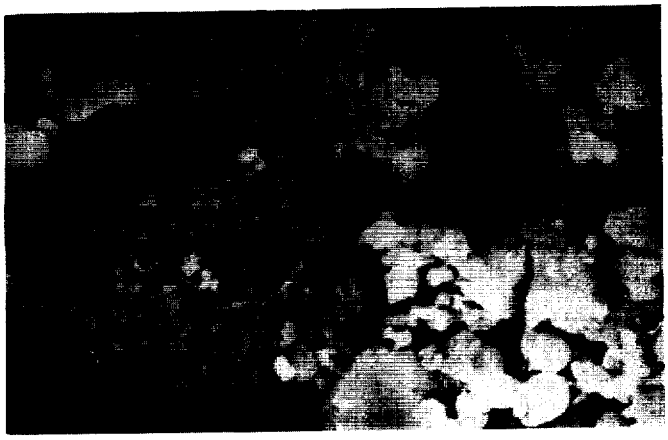
FIG. 7 is a photograph taken through a scanning electron microscope of the extraction residue which occurs when the cut specimen of coking in FIG. 5 is hot extracted with quinoline.

In the test run omitting the additive, the product of hot extracted coke with quinoline was a coky substance grown in a large (more than 1 mm) rigid layer. In the test run involving incorporation of the additive, however, the same product was in the form of minute granules. According to the photograph taken through a scanning electron microscope of these minute granules, the granules are judged to have a particle diameter in the approximate range of from 5 to 10 microns. The conditions are shown in the photographs of FIG. 6 (no additive) and FIG. 7 (additive), respectively.

A test for release of the formed coke by use of compressed jet water revealed that the coke formed in the test run involving the incorporation of the additive could very easily be removed from the inside of the tube but that the coke formed in the test run omitting incorporation of the additive could not very easily be removed, indicating that there was a clear difference in the ease of release; though incapable of quantitative evaluation.

For use in the present example, the Laterite was pulverized to a particle diameter fine enough to pass 100 mesh, placed in 5N caustic soda aqueous solution at an approximate proportion of 1 : 4 (by weight), treated therein at 130° C for 15 hours while under reflux, then separated in the form of precipitate, washed with water three times and dried. The Laterite thus treated was found to contain 3,000 ppm of sodium. It was then tested for micropore distribution by the method of mercury permeation under pressure to find that for the assumed pore diameter distribution in the range of from 100 to 1,000 A, the pore volume was 0.22 cc/g in the treated Laterite and about 0.025 cc/g in the untreated Laterite, indicating that the treatment had resulted in a great increase in the micropore volume. The same trend was also confirmed with respect to pores of smaller diameters by the method using adsorption of methanol.

The additive obtained by the treatment described above, thus, lessens the coking trouble which the heavy petroleum oil undergoes in the course of the thermal cracking treatment in the tubular type heating furnace.

The sodium contained in the additive may possibly form a certain type of chemical bond through an unknown mechanism; it has been confirmed that substantially no release of sodium into the oil occurs during the heat treatment.

When the entire volume of the oil obtained by the heat treatment was incinerated for two hours in a quartz crucible in air at 800° C, about 3 percent by weight of the whole vanadium (195 ppm) contained originally in the feed oil was vaporized, possibly in the form of oxide into the atmosphere. This observation leads to a logical conclusion that the presence of 1 percent by weight of the Laterite treated with caustic soda is effective in curbing loss of vanadium.

A total of eight 30-mesh metal gauzes were disposed in an adherent stack in front of a small burner. The bottom oils of the flushing tower obtained in the test run involving incorporation of 1 percent by weight of the additive and obtained in the test run omitting incorporation of the additive were jetted aflame from the burner nozzle against the stack of gauzes. After this combustion was continued for one hour, deposition of a fused substance on the meshes of the gauzes could be observed microscopically in the case of the oil treated omitting the additive. In contrast, in the case of the oil treated after incorporation of 1 percent by weight of the additive, a readily removable ash was observed to be deposited on the meshes of gauzes. The results indicate that when the bottom oil of the flushing tower obtained in the test run involving incorporation of the additive is used as a fuel in a boiler, scaling in the boiler operation will be lessened to a considerable degree.

When burning the bottom oil by injection against a small burner, the resulting exhaust gases were assumed to contain about 1400 ppm of $SO_x$ in view of the sulfur content in the bottom oil. However, the exhaust gases actually contained only 95 ppm of $SO_x$. Especially, in the exhaust gases, the content of $SO^3$ which would cause corrosion of the air preheater was reduced remarkably to an extremely low concentration below 5 ppm. In view of this fact, it was expected that the use of the bottom oil as a fuel would make it possible to lessen the corrosion of the combustion equipment. The $NO_x$ content in the exhaust gases was as small as 28 ppm, about an 80 % (by weight) reduction as compared with the $NO_x$ content in the exhaust gases resulting from combustion of the bottom oil without the additive. It was also assumed that the reductions in the amounts of $SO_x$ and $NO_x$ components of the exhaust gases were due to adsorption of $SO_x$ and $NO_x$ by the additive in the oil.

EXAMPLE 2

A crude oil of Arabian Light was treated in the same apparatus by the same procedure as described in Example 1 until the light-weight oil contained therein at a proportion of 60 percent by weight was wholly distilled off. Consequently, there was obtained an oil having an API specific gravity of 13.5. In the same apparatus as used in Example 1, this oil (as the starting material) was subjected to a thermal treatment. With the substances indicated in Table 1 each used as the additive and the metal bath for the stainless steel tube for heat treatment kept at the temperature indicated in the same Table, various test runs were made with incorporation of 1 percent by weight of the additive.

Table 1

| Test run | Additive | Conditions for alkali treatment | Temperature |
|---|---|---|---|
| 1 | Bauxite | 5N caustic soda, 130° C, 15 hours | 450° C |
| 2 | Bauxite | 5N caustic soda, 130° C, 15 hours | 460° C |
| 3 | Bauxite | 5N caustic soda, 130° C, 15 hours | 470° C |
| 4 | Bauxite | 5N caustic soda, 130° C, 15 hours | 480° C |
| 5 | Magnesite | 5N caustic soda, 130° C, 20 hours | 470° C |
| 6 | Kyoto yellow ochre | 5N caustic soda, 130° C, 15 hours | 470° C |

In a distillation test for the purpose of evaluating the extent of conversion of the oil (starting material) to the light-weight oil, the resultant oil (mixture of the bottom oil of the flushing tower and the distillate of the flushing tower) was introduced into a 300-ml flask, kept at 350° C by means of a metal bath and agitated at 60 rpm for 30 minutes under a pressure reduced to 5 mmHg by means of a vacuum pump to effect distillation of the light fraction. Then, the residue of distillation which remained in the flask was weighed. The oil (starting material) was tested for determination of fixed carbon content. Based on the numerical values thus obtained, the percentage conversion to the light-weight oil (extent of conversion) was calculated on the basis of the following formula.

$$\frac{100 - B}{100 - A} \times 100 = \text{Extent of conversion to light fraction (\%)}$$

wherein, A denotes the fixed carbon content (%) of starting material and B the amount (%) of the residue in the flask.

Figure 8:
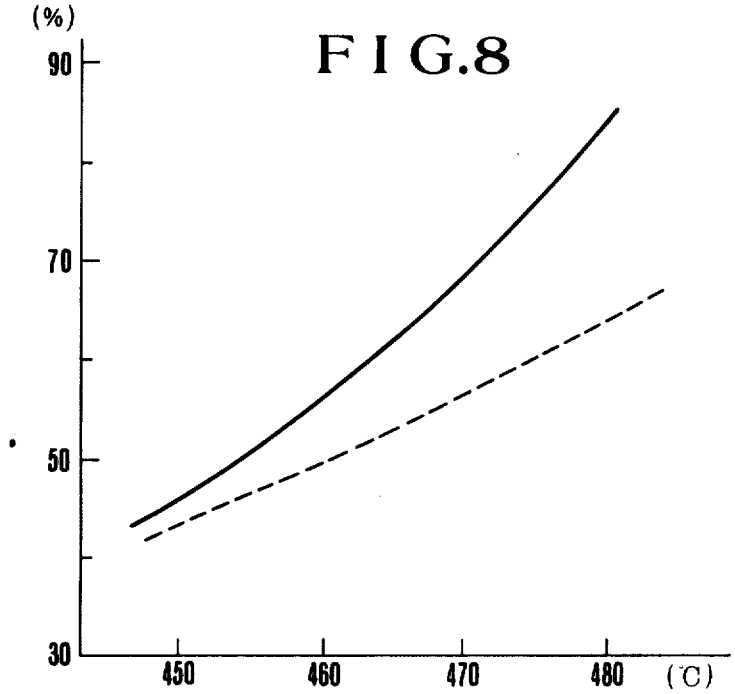
FIG. 8 is a graph showing the relations between the treating temperature (° C) and the extent of conversion to light oil (%) observed when the heavy petroleum oil (having an API specific gravity of not more than 25) having incorporated therein the inorganic substance used in the present invention and that not incorporating the inorganic substance are subjected to the thermal cracking treatment.
Figure 9:
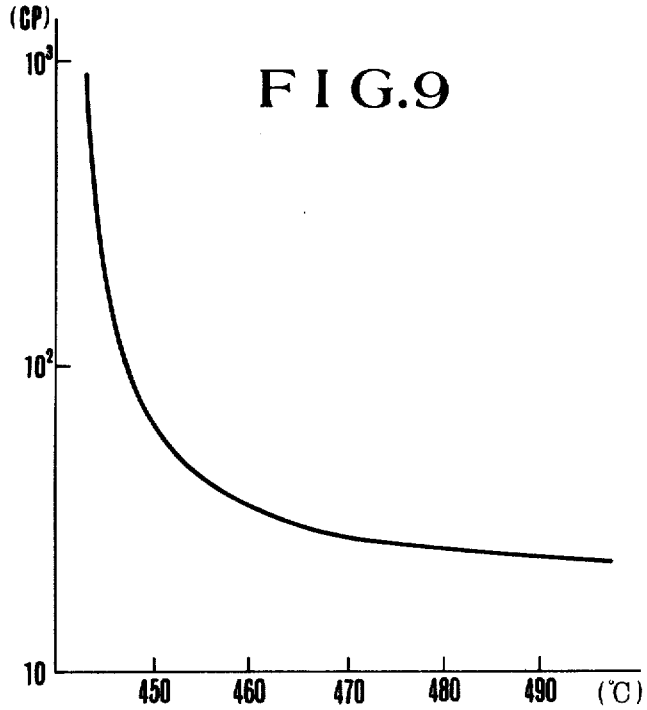
FIG. 9 is a graph showing the relationship between the treating temperature (° C) and the viscosity (cp at 50° C) as observed when the heavy petroleum oil is treated in accordance with the present invention.

FIG. 8 shows the relations between the temperature of heat treatment (° C) and the extent of conversion to the lightweight oil (%). In the graph of FIG. 8, the horizontal axis is graduated for temperature of heat treatment (° C) and the vertical axis for extent of conversion of light fraction (%), respectively. In the graph, the continuous line represents the data obtained by the test run with incorporation of 1 percent by weight of the additive and the dotted line the data obtained by the test run omitting the additive. It is seen from the graph that incorporation of the additive serves to accelerate the conversion of the starting material into the light fraction as compared with the test run without the additive and that the difference in the extent of conversion between the presence and absence of the additive increases with the increasing temperature of heat treatment. Also in terms of viscosity, the results shown in FIG. 9 confirm that the incorporation of the additive serves to decrease the viscosity to a notable extent. The additive, thus, is shown to have functioned as a catalyst for the thermal cracking treatment. In the graph of FIG. 9, the horizontal axis is graduated for temperature of heat treatment (° C) and the vertical axis for viscosity (cp at 50° C), respectively.

EXAMPLE 3

A vacuum residue of Khafji crude (having an API specific gravity of 7.2) containing 1 percent by weight of Garnierite which had been subjected to alkali treatment was subjected to a heat treatment in the same apparatus by the same procedure as in Example 1, except that the storage tank was heated to 140° C and the tube for heat treatment had an inside diameter of 5 mm.

Figure 10:
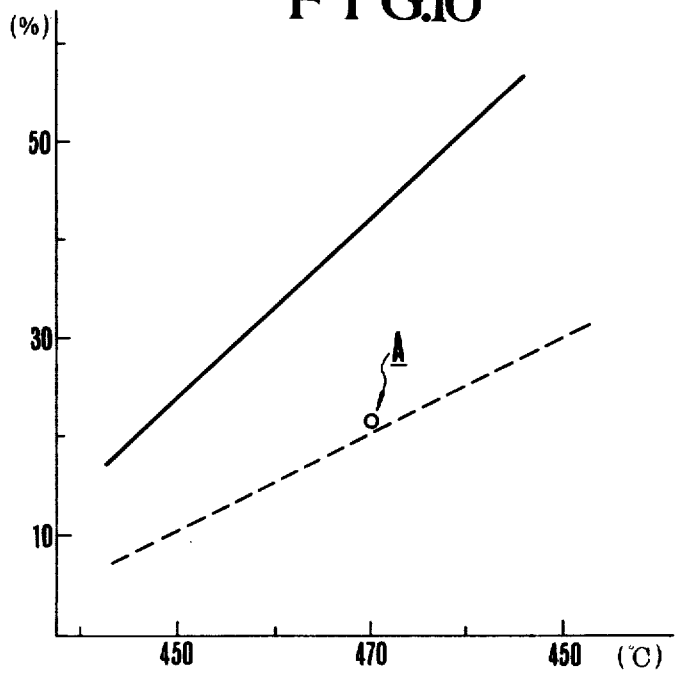
FIG. 10 is a graph showing the relationship between the treating temperature (° C) and the extent of conversion to light oil (%) as observed when the vacuum residue of Khafji crude (having an API specific gravity of 7.2) is subjected to the thermal cracking treatment in accordance with the present invention after incorporation therein of 1 percent by weight of Garnierite treated in advance with an alkali.
Figure 11:
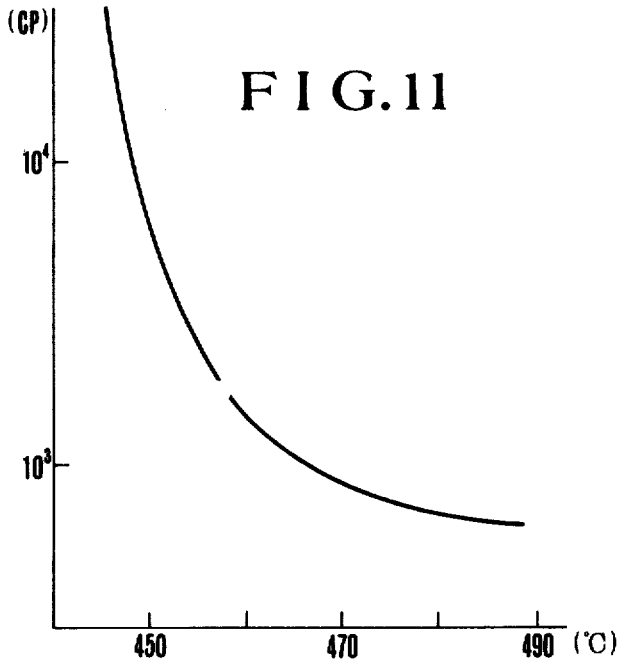
FIG. 11 is a graph showing the relationship between the treating temperature (° C) and the viscosity (cp at 50° C) as observed when the vacuum residue of Khafji crude (having an API specific gravity of 7.2) is subjected to the thermal cracking treatment in accordance with the present invention after incorporation therein of 1 percent by weight of Garnierite treated in advance with an alkali.

FIG. 10 shows the relations between the temperature of heat treatment (° C) and the extent of conversion to the light-weight oil (%). A review of the graph indicates that incorporation of the treated Garnierite promoted the conversion to a great extent as compared with the test run omitting the treated Garnierite. In the graph of FIG. 10, the horizontal axis is graduated for temperature of heat treatment (° C) and the vertical axis for extent of conversion to the light fraction (%). In FIG. 10, the continuous line denotes the data obtained of the test run using 1 percent by weight of the Garnierite treated in advance with an alkali, the dotted line the data obtained of the test run omitting the Garnierite and A the data obtained of the test run with 1 percent by weight of untreated Garnierite, respectively. As to the viscosity, it is seen from the data of FIG. 11 that while the oil starting material has an original viscosity of more than 10 cp at 50° C, the oil resulting from the heat treatment shows a greatly decreased viscosity. In the diagram of FIG. 11, the horizontal axis is graduated for temperature of heat treatment (° C) and the vertical axis for viscosity (cp at 50° C), respectively. The oil fraction obtained by extracting the bottom oil of the flushing tower with normal pentane was analyzed by the procedure of Example 1 and was found to contain 10 ppm of vanadium, 5 ppm of nickel and 8 ppm of sodium as compared to the respective contents of 160 ppm of vanadium, 50 ppm of nickel and 80 ppm of sodium originally found in the starting oil. The insoluble fraction remaining after the extraction of the bottom oil of the flushing tower with quinoline was less than 1 percent by weight, indicating little coking had occurred in the tube.

For use in this example, the Garnierite was treated in advance in 5N caustic potash aqueous solution at 150° C for 15 hours under reflux by following the procedure of Example 1. The treated Garnierite had a surface area of 108 $m^2/g$. For the purpose of comparison, test runs, some involving incorporation of untreated Garnierite and others omitting incorporation of Garnierite, were made with the same apparatus as in Example 1, except that the tube for heat treatment had an inside diameter of 5 mm and the temperature of heat treatment was fixed at 470° C. The results showed practically no difference in conversion to light fraction. Then, a 50-hour continuous operation was attempted with the volume of delivery by the gear pump and the temperature of metal bath varied as indicated in Table 2 for the purpose of determining the effects of delivery volume and temperature upon the pressure inside the system in the course of the operation. It was, consequently, learned that pressure variation was frequently observed in the test runs omitting incorporation of the additive, implying that partial coking and its attendant gasification occurred in the system. In the test runs with the additive, however, the operation proceeded quite stably without the slightest pressure variation. Here, a statement that the volume of delivery was large is equivalent to a statement that the duration of heat treatment was short.

Table 2

| Condition No. | Volume delivered (l/hr.) | Temperature of metal bath (° C) |
|---|---|---|
| 1 | 0.5 | 480 |
| 2 | 1 | 470 |
| 3 | 3.5 | 495 |

In a test run performed under Condition No. 1 without incorporation of the additive, the 50-hour continuous operation was manageable, although rise of pressure was observed. In a test run performed under Condition No. 2 without incorporation of the additive, however, the continuous operation had to be discontinued in the 22nd hour because the pressure in the system rose to 18 kg/cm². In a test run performed under Condition No. 3 without incorporation of the additive, the pressure was observed to increase in the 5th hour and the pressure fell back temporarily but again rose gradually in the 8th hour and it sharply increased to reach 25 kg/cm² around the 15th hour, compelling discontinuation operation.

The oil blown down at 200° C from the bottom of the flushing tower in a test run performed under Condition No. 3 was filtered with two filters of stainless steel gauze, one with 30-mesh and the other with 100-mesh, stacked one on top of the other. The coky substance caught on the filter meshes was larger both in particle diameter and volume in the test run omitting incorporation of the additive than in the test run involving incorporation of the additive.

EXAMPLE 4

Using the apparatus and procedure of Example 1, various oils (having an API specific gravity of not more than 25) were subjected to the heat treatment, with each oil containing 1 percent by weight of Garnierite (having a surface area of 120 m²/g) treated in advance in a 3N caustic soda aqueous solution at 130° C under reflux.

In this case, however, the furnace tube had an inside diameter of 5 mm and the temperature of heat treatment was fixed at 470° C and the flow rate was 1 liter/hour.

Table 3 gives data comparing the viscosity at 50° C and the insoluble fraction remaining after quinoline extraction.

Table 3

| Feed Oil | Viscosity of feed oil (cp at 50° C) | Oil after heat treatment: Viscosity (cp at 50° C) | Oil after heat treatment: Insoluble fraction (%) remaining after quinoline extraction |
|---|---|---|---|
| Arabian Light Atm. Res. | 650 | 32 | Trace |
| Iranian Heavy Atm. Res. | 460 | 35 | 0.15 |
| Boscan Crude Oil | 7,860 | 380 | 0.50 |
| Monagas Atm. Res. | 62,000 | 438 | 0.55 |
| Wafra Atm. Res. | 4,900 | 195 | 0.27 |
| Cyrus Atm. Res. | 72,000 | 140 | 0.35 |
| Resgarib Atm. Res. | 4,310 | 996 | 0.24 |
| Iranian Heavy Vac. Res. | 6,000(1) | 1,120 | 0.95 |
| Khafji Vac. Res. | 9,000(2) | 910 | 0.77 |

The values of viscosity given in (1) and (2) above are those obtained at 100° C. When measured at 50° C, their respective values exceeded $10^6$ cp. It is confirmed by the data given above that in all of the oils tested, the heat treatment served to decrease their viscosity to a great extent. Also the quinoline-insoluble fractions were very small, possibly indicating that the incorporation of the treated Garnierite curbed the formation of coking.

EXAMPLE 5

Using the apparatus and the procedure of Example 1, natural asphalt (having an API specific gravity of 3.0 and a sulfur content of about 6 percent by weight) produced in the Kaboengka District of Buton Island in Indonesia was subjected to an accelerated coking test. In this case, however, the storage tank was heated to 130° C. As the additive, one of the various inorganic substances listed in Table 4 below was selected and incorporated in an amount of 0.5 percent by weight.

Table 4

| Test Run No. | Kind of inorganic substance | Place of origin | Conditions for alkali treatment | Surface area | Ratio of coking time |
|---|---|---|---|---|---|
| 1 | Laterite | Philippine.Nonoc | in 8N potassium carbonate aqueous solution, 110° C, 50 hours | 165 m²/g | 18.3 |
| 2 | Laterite | Philippine.Homonhon. | in 1N caustic soda aqueous solution, 200° C, 15 hours | 92 m²/g | 8.2 |
| 3 | Laterite | Indonesia.Larok | in 5N caustic potash aqueous solution, 185° C, 30 hours | 88 m²/g | 5.1 |
| 4 | Laterite | Shin-pou mine | in 5N caustic potash aqueous solution, 160° C, 5 hours | 56 m²/g | 2.4 |
| 5 | Bauxite | Malaya | in 8N caustic soda aqueous solution, 160° C, 12 hours | 40 m²/g | 3.8 |
| 6 | Garnierite | New Caledonia | in 5N caustic soda aqueous solution, 150° C, 4 hours | 70 m²/g | 6.0 |

The ratio of the coking time in a test run incorporating the additive to the coking time in a corresponding test run incorporating no additive was as shown in Table 4. The ratios suggested that the incorporation of the additive invariably curbs coking. In Test Run No. 6, for example, the alkali treatment resulted in an increase in the pore volume particularly with respect to pores measuring less than 1,000 A as compared with the raw material. The increase was to three times in the pores measuring from 100 to 1,000 A in diameter, for example.

EXAMPLE 6

An experiment similar to that of Example 5 was carried out by incorporating, as the additive, one of the various substances listed in Table 5 below in a proportion of 1 percent by weight.

Table 5

| Test Run No. | Kind of inorganic substance | Conditions for treatment | Surface area | Ratio of coking time |
|---|---|---|---|---|
| 1 | Magnesite | in 5N caustic soda aqueous solution, 150° C, 15 hours | 49 m²/g | 8.2 |

Table 5-continued

| Test Run No. | Kind of inorganic substance | Conditions for treatment | Surface area | Ratio of coking time |
|---|---|---|---|---|
| 2 | Kyoto yellow ochre | in 5N caustic soda aqueous solution, 150° C, 15 hours | 45 $m^2/g$ | 4.9 |
| 3 | Fly ash | in 5N caustic soda aqueous solution, 150° C, 15 hours | 40 $m^2/g$ | 2.1 |
| 4 | Activated Clay | in 5N caustic soda aqueous solution, 150° C, 15 hours | 300 $m^2/g$ | 1.3 |
| 5 | Blast furnace slag | in 5N caustic soda aqueous solution, 150° C, 15 hours | 12 $m^2/g$ | 1.0 |
| 6 | Clinobutelorite | in 5N caustic soda aqueous solution, 150° C, 15 hours | 210 $m^2/g$ | 1.0 |
| 7 | Pentlandrite | in 5N caustic soda aqueous solution, 150° C, 15 hours | 42 $m^2g$ | 1.0 |
| 8 | Carbon black | — | 400 $m^2/g$ | 1.0 |
| 9 | Activated carbon (coal origin) | — | 900 $m^2/g$ | 1.0 |
| 10 | Garnierite | in 5N sulfuric acid solution, 150° C, 15 hours | 22 $m^2/g$ | 1.2 |

In the test runs with Magnesite, Kyoto yellow ochre and fly ash, superiority of operation with incorporation of the additive over that omitting the additive was conspicuous. In the test runs with other inorganic substances, however, no appreciable change could be observed.

The poor results in the test runs with activated carbon, clinobutelorite of natural zeolite, clay, etc. serve to prove that surface area is not the sole factor. In spite of the fact that finely powdered carbon black possesses a large surface area, it failed to bring about any appreciable effect which suggests that particle diameter and surface area are not the sole factors.

Additives No. 1, No. 2, No. 3, No. 7 and No. 10 contained iron in relatively high proportions. Laterite, No. 7 and No. 10 contained nickel. No nickel, however, was contained in Bauxite, red mud, Magnesite, etc. Thus, the composition is a factor of uncertain influence. It has been definitely established, however, that the addition of the substance which is specified herein and which has its surface area increased by virtue of an alkali treatment serves the purpose of definitely decreasing coking.

The additive treated with an acid proved to be little effective, even when incorporated in a proportion twice as large. A sample of the product obtained in Test Run No. 6 of Example 5 was sulfurized with hydrogen sulfide in an autoclave. The sulfurized additive showed a coking time ratio of 6.2, representing a slight increase over the ratio 6.0 shown by the corresponding unsulfurized additive. The slight increase is not considered an ample improvement. A more logical conclusion may be that this effect was produced by the hydrogen sulfide produced in the course of the heat treatment.

EXAMPLE 7

An accelerated coking test similar to that of Example 6 was carried out on the various raw materials (having an API specific gravity of not more than 25) indicated in Table 6.

The additive was Laterite treated with an alkali as in Example 1, incorporated in a proportion of 1 percent by weight. In all the tests superior operation was recognized when the additive was used.

When a sample of the bottom oil of the flushing tower taken while the interior of the apparatus was relatively clean in the early course of the operation was spread in a thin film on a slide glass and observed through a microscope, there was detected a clearly discernible difference in the degree of gelation between that produced by operation with the additive and that from the corresponding operation omitting incorporation of the additive. It was also noted that the fineness and uniformity of gel particles increased with the increasing length of coking time. In the absence of the additive, coarse gel particles or coky particles were observed in large number.

What is claimed is:

1. In a process for the thermal cracking of a heavy petroleum oil having an API specific gravity of not more than 25, within a tubular type heating furnace at a temperature of not less than 400° C, the improvement comprising:

mixing the heavy petroleum oil feed to the furnace with 0.5 to 5% by weight of an inorganic substance having a surface area of not less than $30m^2/g$ and an average particle diameter of not more than 30 microns, said inorganic material containing, as principal components, a high melting oxide and an iron oxide, said inorganic material being obtained by alkali treatment of a member selected from the group consisting of Laterite, Garnierite, Magnesite, Fly ash and Kyoto yellow ochre and mixtures thereof.

2. The process of claim 1 wherein said surface area is from 30 to $200m^2/g$.

3. The process of claim 1 wherein the cracking temperature is within the range of from 400° C to 500° C.

* * * * *

Table 6

| No. | Raw material | Treatment | API specific gravity | Ratio of coking time |
|---|---|---|---|---|
| 1 | Iranian Heavy | Vacuum residue | 5.9 | 8.1 |
| 2 | Arabian Mediam | Propane-extracted asphalt | 5.7 | 8.2 |
| 3 | Resgarib | Atomospheric residue | 13.6 | 3.9 |
| 4 | Wafra | Atmospheric residue | 12.5 | 3.7 |
| 5 | Cyrus | Atomospheric residue | 11.8 | 6.6 |
| 6 | Monagas | Atomospheric residue | 10.9 | 2.9 |
| 7 | Arabian Light | Atomospheric residue | 19.5 | 7.7 |
| 8 | Shale Oil | Atomospheric residue | 18.0 | 4.2 |
| 9 | Tar sand Oil | — | 10.0 | 4.1 |
| 10 | Boscan | Crude oil | 10.0 | 2.4 |